United States Patent [19]

Griffiths

[11] 4,329,861

[45] May 18, 1982

[54] METHOD AND APPARATUS FOR DRAWING AND COOLING WIRE

[75] Inventor: Evan Griffiths, Newington, Conn.

[73] Assignee: Orion Machinery and Engineering Corporation, Branford, Conn.

[21] Appl. No.: 179,939

[22] Filed: Aug. 21, 1980

[51] Int. Cl.[3] ..... B21C 9/00

[52] U.S. Cl. ..... 72/14; 72/43; 72/286

[58] Field of Search ..... 72/14, 41, 43, 44, 45, 72/286, 342, 467, 31

[56] References Cited

U.S. PATENT DOCUMENTS

| | | | |
|---|---|---|---|
| Re. 20,067 | 8/1936 | Busey | 72/41 X |
| 2,203,751 | 6/1940 | Simons | 72/45 |
| 3,648,497 | 3/1972 | Long et al. | 72/43 X |
| 3,935,723 | 2/1976 | Fieldsend et al. | 72/41 X |
| 3,973,426 | 8/1976 | Fujita et al. | 72/286 |

FOREIGN PATENT DOCUMENTS

| | | | |
|---|---|---|---|
| 2538177 | 5/1976 | Fed. Rep. of Germany | 72/286 |
| 50-27461 | 9/1975 | Japan | 72/45 |
| 55-24791 | 2/1980 | Japan | 72/45 |

*Primary Examiner*—Ervin M. Combs

*Attorney, Agent, or Firm*—McCormick, Paulding & Huber

[57] ABSTRACT

A dry lubricated wire drawing and cooling apparatus comprising a die holder supporting a pair of dies in coaxially aligned and axially spaced relation. The die holder and dies cooperate to define a cooling chamber through which cooling liquid is circulated and drawn wire is constrained to pass. A sensing device detects approach of a wire end and operates mechanism to shutdown the apparatus and expel cooling liquid from the cooling chamber before the wire end reaches the first one of the dies.

16 Claims, 2 Drawing Figures

AIR
WATER

METHOD AND APPARATUS FOR DRAWING AND COOLING WIRE

BACKGROUND OF THE INVENTION

This invention relates in general to wire drawing apparatus and deals more particularly with an improved wire drawing apparatus of dry lubricated type wherein drawn wire is cooled by direct contact with a cooling liquid.

In a conventional apparatus for drawing steel wire, for example, the wire passes through a lubricant compartment where it picks up dry lubricant, such as soap, before being drawn through a tungsten carbide die to reduce its cross sectional area. Heat is generated during the drawing operation by friction in the die and deformation of the material. It is generally desirable to cool the drawn wire before further drawing, because the heat of the wire generally determines the maximum speed at which the wire can be drawn. Further, if the wire is allowed to remain at elevated temperature for a relatively short time the physical characteristics of the wire may be altered.

In a dry lubricant wire drawing system it is important that the wire be dry before it enters the lubricating compartment, because water on the wire will destroy lubricating qualities of the lubricant causing rapid wear at the die. Typical wire drawing apparatus wherein wire is lubricated by a solid or dry lubricant and cooled by direct contact with a coolant liquid is illustrated and described in U.S. Pat. No. 2,203,751 to Simons for Method and Apparatus for Drawing Wire, issued June 11, 1940, and U.S. Pat. No. 3,973,426 to Fujita et al for Method of Cooling Steel Wire, issued Aug. 10, 1976. In drawing wire with apparatus of the aforedescribed general type wire run-out or breakage is likely to result in escape of coolant liquid from the coolant chamber into the dry lubricant container causing contamination of the lubricant and machine downtime. The present invention is primarily concerned with this problem.

SUMMARY OF THE INVENTION

This invention is concerned with improvements in a dry lubricated wire drawing apparatus of the type having means defining a lubricant compartment for containing a quantity of dry lubricant, a die assembly including drawing die means having an entry end in communication with the lubricant compartment for receiving a wire therethrough and reducing its cross sectional area, and means defining a cooling chamber in communication with the exit end of the drawing die means for maintaining cooling liquid in cooling engagement with the exit end of the drawing die means and with wire leaving the exit end, and means for circulating cooling liquid through the cooling chamber. In accordance with the invention there is provided sensing means for detecting the approach of a wire end portion toward the entry end of the drawing die means, and means responsive to the sensing means for interrupting circulation of cooling liquid through the cooling chamber upon detection of an approaching end portion by the sensing means. Wire is drawn through the drawing die means immediately after having passed through the dry lubricant compartment, cooling liquid is circulated through the cooling chamber and around the wire as it leaves the wire drawing die means. The wire is sensed to detect a wire end portion approaching the entry end of the die means. Circulation of the cooling liquid through the cooling chamber is interrupted upon detection of the approach of a wire end portion.

DETAILED DESCRIPTION OF PREFERRED EMBODIMENT

Figures 1, 2:
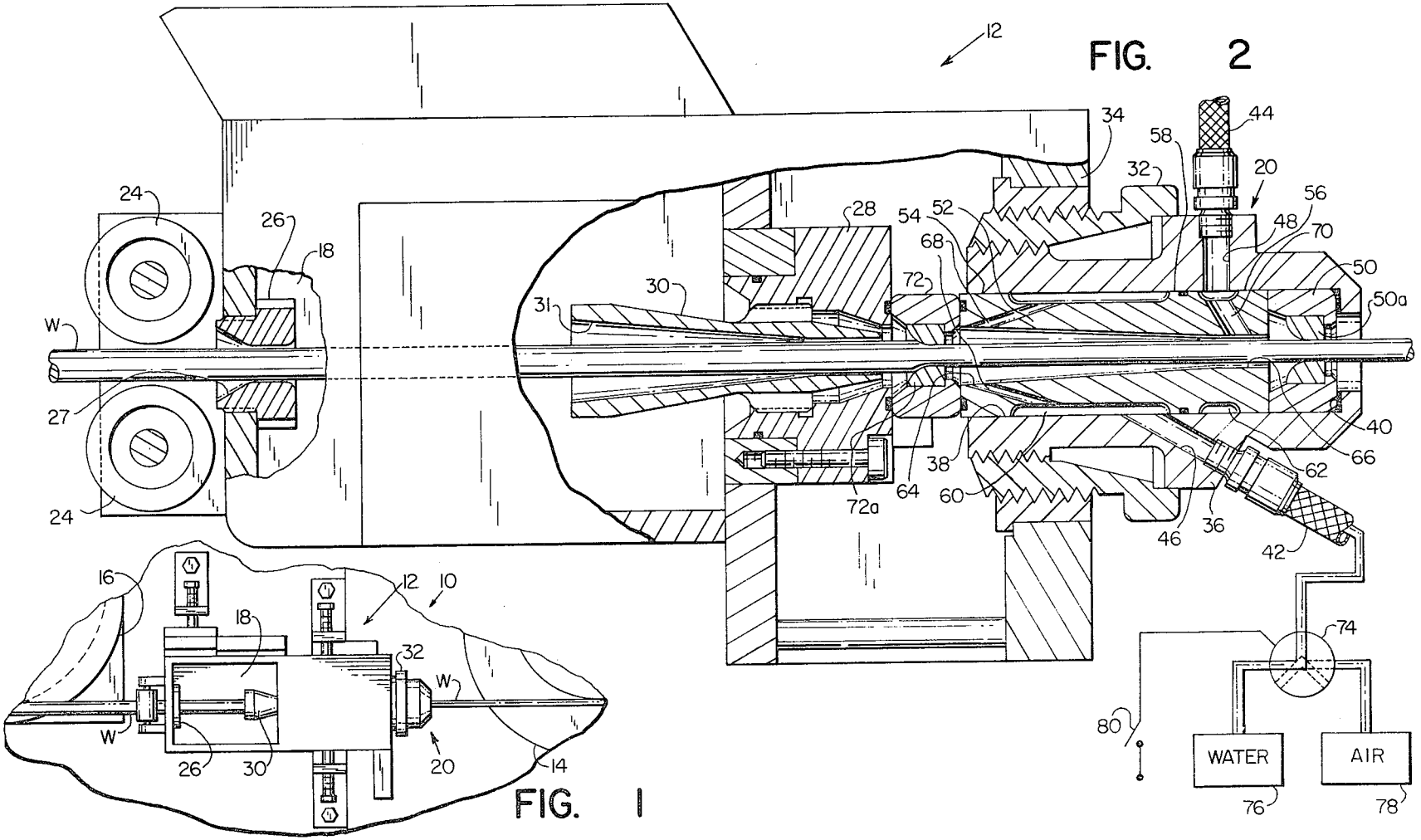
FIG. 1 is a fragmentary plan view of a wire drawing apparatus embodying the present invention.
FIG. 2 is a somewhat enlarged side elevational view of the die box of FIG. 1 shown partially in section taken generally along the line 2—2 of FIG. 1.

Turning now to the drawing, a dry lubricated wire drawing apparatus embodying the present invention is illustrated in FIG. 1 and indicated generally by the reference numeral 10. The illustrated apparatus 10, which may, for example, comprise part of a progressive wire drawing line, includes a die box, designated generally by the numeral 12. The die box 12 is mounted between a capstan or draw block 14 and a wire accumulator 16, which may receive wire, such as indicated at W, from another draw block (not shown). The accumulator supplies wire to the draw block 14 which draws the wire through the die box 12.

Referring now particularly to FIG. 2 the illustrated die box 12 has a lubricant receptacle or compartment 18 at its forward or entry end for containing a quantity of dry lubricant, such as powdered soap, and a die supporting structure at the rear of the lubricant compartment which supports a die assembly indicated generally at 20. The die assembly 20 includes a system for cooling drawn wire by direct contact with a cooling liquid which circulates through a cooling chamber associated with the die assembly. The apparatus 10 further includes an arrangement for interrupting cooling liquid circulation and expelling cooling liquid from the cooling chamber upon detection of approach of an end portion of the wire being drawn to prevent lubricant contamination, all of which will be hereinafter further discussed.

Considering now the die box 12 in further detail, upper and lower guide rollers 24, 24 mounted on the front wall of the die box guide wire W into the box through an annular inlet member 26 which is threaded into the front wall of the die box and has a bore 27 which includes a conically tapered rearwardly converging entry portion. An annular retaining member 28 bolted to the rear wall of the lubricant compartment 18 supports a lubricant tube 30. The lubricant tube has a rearwardly diverging conically tapered bore 31 coaxially aligned with the inlet member bore 27.

The die assembly 20 is secured to the die box 12 by an annular die retaining nut 32 threadably retained in the rear wall of the die box, the latter wall being indicated by the numeral 34. The die assembly includes a die holder 36 threadably connected to the retaining nut 32. A bore 38 extends coaxially through the die holder and has an outlet portion of reduced diameter at its rear end which defines a forwardly facing annular seating surface 40. Inlet and outlet conduits respectively indicated at 42 and 44 are connected, respectively, to inlet and outlet ports 46 and 48 which communicate with the bore 38 for a purpose which will be hereinafter further evident.

A generally cylindrical sealing member or sizing die 50, which may include a tungsten carbide nib such as indicated at **50*a*, is received within the rear portion of the bore 38 in bearing engagement with the seating surface 40, substantially as shown in FIG. 2. The die 50 may, if desired, perform a light drawing operation to "size" the wire, however, the primary function of the die 50 is to cooperate with the wire to seal the exit end of the die assembly 20**, as will be hereinafter further discussed.

The die assembly 20 further includes a generally cylindrical spool-shaped sleeve 52 which is slidably received within the bore 38 immediately forward of the sealing die 50 and which cooperates with the housing 36 to define at least one annular chamber surrounding an associated portion of the sleeve. The illustrated sleeve 52 has a generally cylindrical body portion and diametrically enlarged annular flanges 54 and 56 at its opposite ends which engage the wall of the bore 38. Another annular flange 58 surrounds the body portion of the sleeve intermediate the flanges 54 and 56, substantially as shown in FIG. 2. The body portion of the sleeve 52 and the annular flanges 54, 56 and 58 cooperate with the bore 38 to define two annular chambers 60 and 62 between the housing 36 and the sleeve 52. The annular chamber 60 is in fluid communication with the inner end of the inlet port 46 whereas the annular chamber 62 communicates with the outlet port 48. The sleeve 52 has a coaxial bore which includes a conically tapered rearwardly converging portion 64 which forms a junction with a generally cylindrical portion 66 near the rear end of the sleeve. The cylindrical portion 66 has a diameter slightly larger than the inside diameter of the sealing die nib 50*a*. At least one fluid inlet passageway 68 is formed in the forward end of the sleeve 52 and inclined forwardly and inwardly from the annular chamber 60 to the bore portion 64 and opens through the forward end of the bore portion 64 to provide fluid communication between the chamber 60 and the sleeve bore 64. The number and arrangement of such passageways may vary, but preferably the sleeve 52 has eight (8) equiangularly spaced passageways 68, 68. At least one fluid outlet passageway 70 provides fluid communication between the bore portion 66 and the annular chamber 62. Elastomeric O-rings provide fluid seals at various locations within the die assembly, substantially as shown in FIG. 2.

A drawing die 72, which comprises a part of the die assembly 20 and which may include a tungsten carbine nib such as indicated at 72*a* is clamped between the forward end of the sleeve 52 and the tube retaining member 28 in coaxial alignment with the lubricant tube 30 and the sealing die 50.

A system for circulating cooling liquid to cool the drawn wire W and the drawing die 72 and for expelling coolant from the die assembly 20 in the event of wire runout or breakage is illustrated somewhat schematically in FIG. 2. More specifically, the inlet conduit 42 is connected through a control valve 74 to a source of liquid coolant, preferably water, indicated at 76 and to a source of air under pressure identified by the numeral 78. The valve, which is preferably solenoid operated, is arranged to supply either air or water to the inlet conduit 42. Preferably, the control valve 74 has a third or shutoff position wherein neither air nor water is supplied to the die assembly 20. Alternatively, a separate shutoff valve (not shown) may be provided for this purpose.

A sensing device is provided for detecting the approaching end of a wire W being drawn through the die box 12. Various sensing devices may be employed for this purpose, however, in the illustrated apparatus 10 a proximity switch 80 is used for this purpose. The switch 80, illustrated schematically in FIG. 2, is mounted in close proximity to the path of the wire W and forward of the die box 12. The switch 80 is connected in a control circuit (not shown) to operate the solenoid valve 74 in response to detection of an approaching wire end portion. The control circuit may also be arranged to shutdown the apparatus 10 upon detection of an approaching wire end.

In normal operation wire W is drawn from the accumulator 16 and through the die box 12 by the draw block 14. If normal tension is maintained on the wire W in the region of the proximity switch 80 the control valve 74 will be maintained in a position wherein cooling water is supplied to the die assembly 20 from the water source 76 through the inlet conduit 42. Cooling water flows into the die through the inlet port 46 to the annular chamber 60 and is expelled under pressure and in the direction of the posterior or exit end of the drawing die nib 70*a* through the passageways 68, 68. Cooling water flows rearwardly through bore portions 64 and 66 and out of the bore portion 66 through the outlet passageway 70 into the annular chamber 62 and from the latter chamber through the outlet port 48 to and through the outlet conduit 44 to a suitable drain. A sufficient source of cooling water at a controlled temperature may be supplied to the die assembly 20 to maintain desired wire temperature. In the event of wire runout or breakage, sudden slack in the wire W in the region of the switch 80 causes the switch to actuate the control circuit operating the control valve 74 to cutoff the supply of cooling water to the inlet conduit 42 and to supply air under pressure to the latter conduit whereby to expel cooling water from the die assembly 20 through the outlet conduit 44. The sensing switch 80 will, of course, be located a sufficient distance from the drawing die 72 to assure ample time for "blowing out" the die assembly before the approaching wire end passes through the drawing die 72 thereby preventing escape of water from the die assembly 20 into the lubricant compartment 18.

Although the die 50 may serve as a wire sizing die its primary function is to cooperate with the wire W to provide a seal at the exit end portion of the cooling chamber. The die 50 may be omitted, however, omission of this die will result in expulsion of cooling liquid in an axial direction from the rear end of the die assembly 20, particularly during the "blow out" portion of the cycle hereinbefore described. Since this condition may be objectionable, the provision of a sealing die at the exit end of the die assembly is preferred.

I claim:

1. In a dry lubricating wire drawing apparatus having means defining a lubricant receptacle for containing a quantity of dry lubricant, an axially extending die assembly including drawing die means having an entry in communication with the lubricant receptacle for receiving a wire axially therethrough after the wire has passed through the lubricant receptacle and reducing the cross sectional area of the wire as it is drawn through the drawing die means, means defining a cooling chamber in communication with an exit end of the drawing die means for maintaining cooling liquid in direct contact with the exit end and with wire leaving the exit end, and means for circulating cooling liquid through the cooling chamber, the improvement comprising, sensing means for detecting a wire end portion approaching said entry end of said drawing die means, and means responsive to the sensing means for interrupting circulation of cooling liquid through the cooling chamber upon detection of an approaching wire end portion by said sensing means.

2. In a dry lubricated wire drawing apparatus as set forth in claim 1 the further improvement comprising means responsive to said sensing means for expelling cooling liquid from said cooling chamber upon detection of an approaching wire end portion by said sensing means.

3. In a dry lubricated wire drawing apparatus as set forth in claim 2 the further improvement wherein said interrupting means comprises said expelling means.

4. In a dry lubricated wire drawing apparatus as set forth in any one of claims 1 through 3 wherein said interrupting means comprises a control valve.

5. In a dry lubricated wire drawing apparatus as set forth in claim 4 the further improvement wherein said sensing means comprises a proximity switch disposed proximate the path of wire approaching said drawing die means.

6. In a dry lubricated wire drawing apparatus as set forth in claim 1 the further improvement wherein said means defining said cooling chamber comprises a die holder retaining said drawing die.

7. In a dry lubricated wire drawing apparatus as set forth in claim 6 the further improvement wherein said means defining said cooling chamber further comprises sealing means cooperating with the wire for sealing the exit end of said cooling chamber.

8. In a dry lubricated wire drawing apparatus as set forth in claim 7 wherein said sealing means comprises another die supported by said die holder in axially spaced relation to said drawing die.

9. In a dry lubricated wire drawing apparatus as set forth in claim 6 the further improvement wherein said die holder includes a housing and a sleeve received within said housing and having an axially extending bore defining a portion of said cooling chamber.

10. In a dry lubricated wire drawing apparatus as set forth in claim 9 the further improvement wherein said sleeve and said housing cooperate to define at least one annular chamber which surrounds a portion of said sleeve, said sleeve has a fluid inlet passageway which communicates with said one annular chamber and said cooling chamber, and said one annular chamber and said fluid inlet passageway comprise said circulating means.

11. In a dry lubricated wire drawing apparatus as set forth in claim 10 the further improvement wherein said inlet passageway is inclined inwardly from said annular passageway and in the direction of said exit end and terminates proximate said exit end.

12. In a dry lubricated wire drawing die as set forth in claim 10 wherein said sleeve and said housing define a plurality of annular chambers, said inlet passageway communicates with one of said annular chambers, said sleeve has an outlet passageway which communicates with said cooling chamber and another of said annular chambers, and the other of said annular chambers and said outlet passageway further comprise said circulating means.

13. A method for drawing and cooling wire in a dry lubricated wire drawing system having a die assembly including a wire drawing die and a cooling chamber adjacent an exit end of the wire drawing die and comprising the steps of passing the wire through a dry lubricant, drawing the wire through the die immediately after passing it through the dry lubricant, circulating liquid coolant through the cooling chamber and around the wire as it leaves from the wire drawing die, sensing the wire to detect a wire end portion approaching an entry end of the die, and interrupting the circulation of liquid coolant through the cooling chamber upon detection of the approach of a wire end portion.

14. A method for drawing and cooling wire in a dry lubricated wire drawing system as set forth in claim 13 including the additional step of expelling cooling liquid from the cooling chamber upon detection of the approach of the wire end portion.

15. A method for drawing and cooling wire in a dry lubricated wire drawing system as set forth in claim 14 wherein the step of expelling is further characterized as blowing cooling liquid out of the cooling chamber.

16. A method for drawing and cooling wire in a dry lubricated wire drawing system as set forth in claim 15 wherein the step of blowing cooling liquid is further characterized as introducing air under pressure into the cooling chamber.

* * * * *